United States Patent [19]

Goehler

[11] 4,348,134

[45] Sep. 7, 1982

[54] SCRAPER ASSEMBLY FOR A PADFOOT COMPACTOR, AND METHOD OF FORMING SAME

[75] Inventor: Robert F. Goehler, Greencastle, Pa.

[73] Assignee: Ingersoll-Rand Company, Woodcliff Lake, N.J.

[21] Appl. No.: 114,964

[22] Filed: Jan. 24, 1980

[51] Int. Cl.[3] ..... E01C 19/26; A01B 29/04; A01B 29/06

[52] U.S. Cl. ..... 404/129; 172/547; 172/830

[58] Field of Search ..... 404/129, 124, 128, 121; 172/606, 607, 608, 610, 830, 547; 280/158 R

[56] References Cited

U.S. PATENT DOCUMENTS

| | | | |
|---|---|---|---|
| 250,199 | 11/1881 | Burd | 172/607 X |
| 958,346 | 5/1910 | Williamson et al. | 404/124 X |
| 1,229,868 | 6/1917 | Black | 172/610 X |
| 1,415,759 | 5/1922 | Allen | 172/547 X |
| 3,085,484 | 4/1963 | McAdams et al. | 404/129 X |
| 3,802,339 | 4/1974 | Andersson et al. | 404/129 X |
| 3,891,342 | 6/1975 | Roe | 404/128 |
| 4,147,218 | 4/1979 | Stedman | 172/830 X |
| 4,200,156 | 4/1980 | Van Der Lely et al. | 172/610 X |

FOREIGN PATENT DOCUMENTS

| | | | |
|---|---|---|---|
| 232289 | 4/1910 | Fed. Rep. of Germany | 172/547 |

*Primary Examiner*—Rodney H. Bonck

*Attorney, Agent, or Firm*—David W. Tibbott; Bernard J. Murphy

[57] ABSTRACT

The invention comprises a scraper assembly, and a method of forming same, for mounting forwardly of a padfoot-type, earth-compactor drum for scraping earth, mud and clay accretion from between rows of the padfeet, as well as for scraping the same from the faces of the padfeet, and in an embodiment thereof, the assembly comprises an array of longitudinally disposed and parallel rows of teeth arranged with diverging angles therebetween for efficiently cleaning the padfeet in both rotatable directions of the drum. The teeth are secured firmly to an I-beam which extends across the front of the drum, and a mounting assembly, for a fluid-pressure cylinder, is fixed to the I-beam to control a dozer blade.

11 Claims, 4 Drawing Figures

SCRAPER ASSEMBLY FOR A PADFOOT COMPACTOR, AND METHOD OF FORMING SAME

This invention pertains to earth compactors of the rolling drum-type. Generally, it pertains to padfoot-type, drum compactors, and specifically to a scraper assembly for use in combination with such a compactor drum.

Padfoot-type drum compactors, when working in earth which is muddy or has a significant quantity of clay, or is otherwise viscous, will have much of the earthen material adhere to the drum, between the padfeet and onto the faces thereof as well. This adhesion or accretion militates against the effectiveness of the padfeet and minimizes the compaction to be derived therefrom. Accordingly, it is a well known practice, in the prior art, to fix scraper teeth across the front or rear of the drum to remove the accretion from between the rows of the padfoot. However, prior art types of scrapers typically employ one row of teeth, generally radially directly toward the drum. Consequently, the drum adherent material tends to simply deflect the teeth, and much of the accretion remains. A more efficient practice is to employ teeth which are diverted from a radial plane having, instead, an angle of attack defined by a chord of the drum as the teeth then more efficiently address the down-turning padfeet to remove the adherent material. What is more desirable, however, would be a scraper assembly of the type noted which will remove the accretion upon the drum rotating in both, opposite directions, efficiently to address the down-turning and up-turning padfeet.

It is an object of this invention to set forth such a desired scraper assembly for a padfoot-type, earth-compactor drum. It is also an object of this invention to set forth a scraper assembly, for a padfoot-type earth compactor, comprising a pair of substantially flat, elongate elements; each of said elements having a longitudinal edge with an undulated configuration defined by a series of spaced-apart recesses with intervening, prominently-extending tongues; and means fixing said elements in a spaced-apart, superposed and substantially parallel relationship, with said longitudinal edges, recesses, and tongues in common alignment.

It is also an object of this invention to disclose a method of forming a scraper assembly for a padfoot-type earth compactor, comprising the steps of separating a flat, elongate and rigid strip of metal into two complementary, corresponding pieces, by forming a generally longitudinally-directed, cut therein, from one end of the strip to the end opposite which cut undulates across a longitudinal centerline of said strip; rotating one of the two cut-formed pieces, end-for-end, about an axis normal to its length, and superposing it spaced above the other of the two cut-formed pieces, with the recesses and prominences of the undulations, formed in the cutting, disposed in common alignment, so that the undulations-aligned pieces are disposed in a parallel but spaced-apart adjacency; and fixing the separated pieces in such spaced-apart, parallel, and undulations-aligned adjacency.

Further objects of this invention, as well as the novel features thereof, will become more apparent by reference to the following description, taken in conjunction with the accompanying figures, in which.

Figure 1:
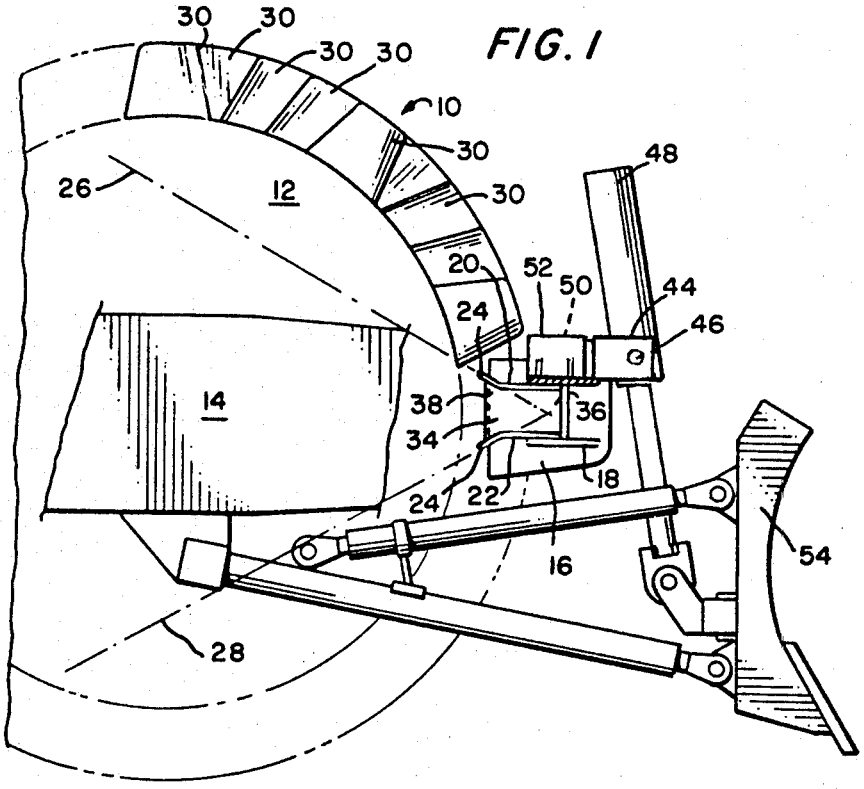
FIG. 1 is a side, elevational view, partially in cross-section, of the front end of a padfoot-type, earth compactor, showing a scraper assembly in operative association therewith, the assembly comprising an embodiment of the invention.
Figure 2:
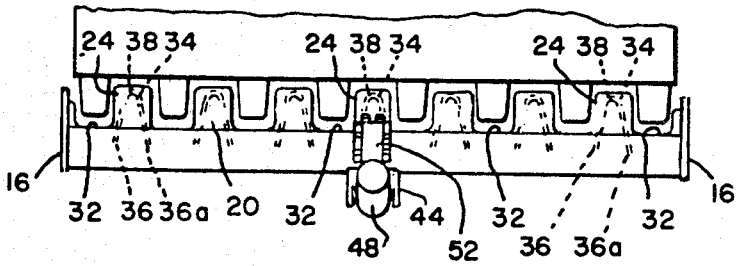
FIG. 2 is a top or plan view of the scraper assembly and only a portion of the drum, of FIG. 1.
Figure 4:
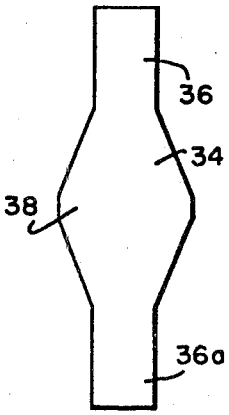
FIG. 4 is a top or plan view of one of the gussets employed between the teeth of the scraper assembly, prior to its being bent and fixed between the teeth.

As shown in the figures, a padfoot-type, drum compactor 10 has a drum 12 which is rotatably mounted on a frame 14 to which side supports 16 are coupled (by means not shown). An I-beam 18 is fixed to and between the side supports 16, across the front of the drum 12. A pair of flat, elongate elements 20 and 22, each having a row of spaced-apart teeth 24 are spaced in parallel and surmounting relationship with the teeth in vertical alignment and cantilevered from I-beam 18. Each element is welded to a rib of the I-beam.

The teeth 24 of the uppermost element 20 are turned upward, and lie along a plane 26 which is coincident with a given chord of the drum 12. The teeth 24 of the lowermost element 22 are deflected downward, and lie along another plane 28 which is coincident with another chord of the drum. Therefore, as the drum 12 rotates in a clockwise, forward direction, the uppermost teeth 24 will scrape accretion from between the rows of the padfeet 30 and edges 32, which define recesses between the teeth 24, will remove accretion from the faces of the padfeet. When the drum 12 rotates in a counterclockwise direction, as when the compactor 10 is moved in reverse, the lower teeth 24 of element 22 perform the aforesaid function.

In order to maintain the teeth 24 in spaced relationship and in the angled planes 26 and 28, gussets 34 are placed therebetween. Each gusset 34 comprise a short, rigid element having uniform widths at opposite ends 36 and **36*a* and a section 38 therebetween of varying widths. The gusset 34 is bent, substantially across the midlength thereof into a V-shaped configuration. Then the ends 36 and 36*a* of the gussets are fixed to the I-beam 18, and section 38** is disposed between the teeth. Each gusset is welded in place.

Figure 3:
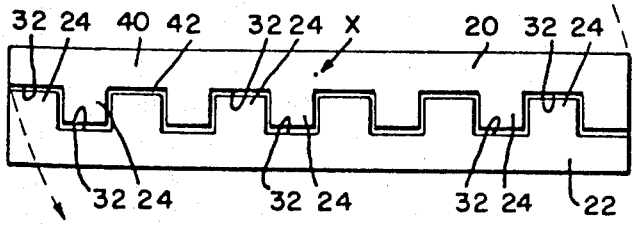
FIG. 3 is a top or plan view of the plate material from which the rows of teeth are cut.

To fabricate the pair of rows of teeth 24 from a single plate 40 of material, i.e. manganal steel, a serpentine or undulated cut 42 is made in the material as shown in FIG. 3. The one half-piece, corresponding to element 20, is turned end-for-end on an axis "X" normal to the material 40, and is disposed in parallel, spaced above, and in vertical alignment with the other half-piece (which corresponds to element 22). Then the V-formed gussets 34 are welded into place between the teeth 24 and to the I-beam 18.

In that the I-beam 18 presents such a solid structural element, it is a teaching of this invention to place a yoke-type bracket 44, having means 46 for pivotably supporting a fluid-pressure cylinder 48 thereon. The bracket 44 has a support shaft 50 coupled to, and extending therefrom, which is rotatably mounted in a journal housing 52 which is fastened atop the I-beam 18. It is common practice to use a dozer blade 54 for moving mounds of earth, or gravel, or the like, and typically hydraulic cylinders are mounted to opposite ends of the blade to move same. However, in order to move the blade in elevation, with a pair of cylinders, it is necessary to have a more complex hydraulic system, i.e., one employing flow dividers and the like. It would always have been simpler and less expensive to use a single cylinder 48 for operating the dozer blade 54. However, heretofore there has not been any firm structure, forward of, and mid-way across the drum 12, to which a single, dozer blade operating cylinder could be fixed. It is my teaching, then, to employ the I-beam 18, secured to side supports 16, both for carrying the improved scraper assembly, of elements 20 and 22, and gussets 34, and for carrying and universally-mounting the fluid-pressure cylinder 48.

While I have described my invention in connection with a specific embodiment thereof, it is to be clearly understood that this is done only by way of example, and not as a limitation to the scope of my invention as set forth in the objects thereof and in the appended claims.

I claim:

1. A scraper assembly, for a padfoot-type earth compactor, comprising:

a pair of substantially flat, elongate elements;

each of said elements having a longitudinal edge with an undulated configuration defined by a series of spaced-apart recesses with intervening, prominently-extending tongues; and means fixing said elements in a spaced-apart, superposed and substantially parallel relationship, with said longitudinal edges, recesses, and tongues in common alignment; wherein said elements each have a planar portion subsisting in a given plane;

said tongues of each element are angularly disposed relative to said planar portions;

said fixing means comprises wall means interposed between, and fixed to, said tongues of said elements, to secure said tongues to said common alignment;

said wall means comprises means for securing said tongues in said common alignment and for maintaining said tongues in said angular disposition with a divergent angle therebetween;

said wall means comprises gussets; and each of said gussets having a portion of one uniform width and a portion of greater width than said one width; and said gusset portion of one width is fixed to said planar portions of said elements, and said gusset portion of greater width is fixed to said tongues to maintain said divergent angle therebetween.

2. A scraper assembly, according to claim 1, wherein:

said tongues of one of said elements cooperate with said tongues of the other of said elements to define a divergent angle therebetween.

3. A scraper assembly, according to claim 1, wherein:

each of said gussets is substantially U-shaped, having portions of said one uniform width at opposite ends thereof, and having said portion of greater width intermediate said ends thereof.

4. A scraper assembly, according to claim 1, wherein:

said fixing means further comprises an elongate, rigid, and channel-shaped component having a rib and a pair of parallel walls projecting from said rib; and said planar portions of said elements are fastened to said walls.

5. A scraper assembly, according to claim 4, further including:

means fixed to said channel-shaped component for journaling a support shaft thereat.

6. A scraper assembly, for a padfoot-type earth compactor, comprising:

a pair of substantially flat, elongate elements;

each of said elements having a longitudinal edge with an undulated configuration defined by a series of spaced-apart recesses with intervening, prominently-extending tongues; and means fixing said elements in a spaced-apart, superposed and substantially parallel relationship, with said longitudinal edges, recesses, and tongues in common alignment; wherein said elements each have a planar portion subsisting in a given plane;

said tongues of each element are angularly disposed relative to said planar portions; and said fixing means comprises an elongate, rigid, and channel-shaped component having a rib and a pair of parallel walls projecting from said rib; and said planar portions of said elements are fastened to said walls; and further including means fixed to said channel-shaped component for journaling a support shaft thereat;

a bracket;

said bracket having means for pivotably supporting a cylinder thereon; and a support shaft coupled to said bracket, and rotatably mounted in said journaling means.

7. A scraper assembly, according to claim 6, wherein:

said fixing means further comprises wall means interposed between, and fixed to, said tongues of said elements, to secure said tongues in said common alignment.

8. A scraper assembly, according to claim 6, wherein:

said component comprises an I-beam.

9. In combination with a padfoot-type, cylindrical drum for an earth compactor, a scraper assembly, comprising:

first means defining a first plurality of teeth, for scraping detritus from said drum, disposed in a first plane defined by a given chord of said drum;

second means defining a second plurality of teeth, for scraping detritus from said drum, disposed in a second plane defined by another chord of said drum; and means fixing said pluralities of teeth in spaced-apart relationship and in adjacency to said drum; wherein said fixing means comprises an elongate, rigid and channel-shaped component having a rib and a pair of parallel walls projecting from said rib;

said first plurality of teeth is fixed to one of said walls; and said second plurality of teeth is fixed to the other of said walls; and further including means fixed to said channel-shaped component for journaling a support shaft thereat;

a bracket;

said bracket having means for pivotably supporting a cylinder thereon; and a support shaft coupled to said bracket, and rotatably mounted in said journaling means.

10. The combination, according to claim 9, wherein:

said first and second pluralities of teeth define a divergent angle therebetween.

11. The combination, according to claim 10, wherein:

said drum has a cylindrical surface, and a multiplicity of padfeet, extending radially from said surface, in spaced-apart disposition; and said first and second means comprise teeth in which each of said teeth have a first scraper edge disposed in adjacency to said cylindrical surface, and second and third substantially parallel scraper edges, which separately define junctures with opposite ends of said first scraper edge, said second and third scraper edges being disposed in adjacency to lateral surfaces of said padfeet, and intruding into spaces subsisting between said padfeet; and said first and second means further comprises fourth scraper edges, obtaining between adjacent teeth, disposed in adjacency to radially outermost surfaces of said padfeet.

* * * * *